US006105718A

United States Patent [19]

Stewart

[11] Patent Number: 6,105,718

[45] Date of Patent: Aug. 22, 2000

[54] ROOFER'S EXTEND-A-LEG

[76] Inventor: Lucas J. Stewart, 1412 10th Ave. SouthEast #3, Rochester, Minn. 55904

[21] Appl. No.: 09/353,959

[22] Filed: Jul. 15, 1999

[51] Int. Cl.[7] ..... A62B 35/00

[52] U.S. Cl. ..... 182/45; 248/237; 182/100; 482/75

[58] Field of Search ..... 182/100, 189, 182/45; 248/237; 482/75

[56] References Cited

U.S. PATENT DOCUMENTS 5,806,626 9/1998 Jenkins ..... 182/100

*Primary Examiner*—Alvin Chin-Shue

[57] ABSTRACT

A roofer's step stilt for providing an adjustably extendable stilt for bracing on a toe hold structure on a roof top to allow a roofer to step thereon to reach higher up locations without requiring additional scaffolding to be constructed. The roofer's step stilt includes a tubular elongate top and bottom members each having upper and lower ends and a longitudinal axis extending between the respective upper and lower ends. The lower end of the top member telescopically receives the upper end of the bottom member into the top member. An upper footrest plate is coupled to the upper end of the top member. A lower footrest plate is outwardly extended from the top member adjacent the lower end of the top member.

6 Claims, 2 Drawing Sheets

ROOFER'S EXTEND-A-LEG

BACKGROUND OF THE INVENTION

1. Field of the Invention

The present invention relates to roof-top scaffolding accessories and more particularly pertains to a new roofer's step stilt for providing an adjustably extendable stilt for bracing on a toe hold structure on a roof top to allow a roofer to step thereon to reach higher up locations without requiring additional scaffolding to be constructed.

2. Description of the Prior Art

The use of roof-top scaffolding accessories is known in the prior art. More specifically, roof-top scaffolding accessories heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 2,477,893; 4,032,140; 3,660,920; 5,113,971; 5,318,148; and Des. 371,608.

While these devices fulfill their respective, particular objectives and requirements, the aforementioned patents do not disclose a new roofer's step stilt. The inventive device includes a tubular elongate top and bottom members each having upper and lower ends and a longitudinal axis extending between the respective upper and lower ends. The lower end of the top member telescopically receives the upper end of the bottom member into the top member. An upper footrest plate is coupled to the upper end of the top member. A lower footrest plate is outwardly extended from the top member adjacent the lower end of the top member.

In these respects, the roofer's step stilt according to the present invention substantially departs from the conventional concepts and designs of the prior art, and in so doing provides an apparatus primarily developed for the purpose of providing an adjustably extendable stilt for bracing on a toe hold structure on a roof top to allow a roofer to step thereon to reach higher up locations without requiring additional scaffolding to be constructed.

SUMMARY OF THE INVENTION

In view of the foregoing disadvantages inherent in the known types of roof-top scaffolding accessories now present in the prior art, the present invention provides a new roofer's step stilt construction wherein the same can be utilized for providing an adjustably extendable stilt for bracing on a toe hold structure on a roof top to allow a roofer to step thereon to reach higher up locations without requiring additional scaffolding to be constructed.

The general purpose of the present invention, which will be described subsequently in greater detail, is to provide a new roofer's step stilt apparatus and method which has many of the advantages of the roof-top scaffolding accessories mentioned heretofore and many novel features that result in a new roofer's step stilt which is not anticipated, rendered obvious, suggested, or even implied by any of the prior art roof-top scaffolding accessories, either alone or in any combination thereof.

To attain this, the present invention generally comprises a tubular elongate top and bottom members each having upper and lower ends and a longitudinal axis extending between the respective upper and lower ends. The lower end of the top member telescopically receives the upper end of the bottom member into the top member. An upper footrest plate is coupled to the upper end of the top member. A lower footrest plate is outwardly extended from the top member adjacent the lower end of the top member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new roofer's step stilt apparatus and method which has many of the advantages of the roof-top scaffolding accessories mentioned heretofore and many novel features that result in a new roofer's step stilt which is not anticipated, rendered obvious, suggested, or even implied by any of the prior art roof-top scaffolding accessories, either alone or in any combination thereof.

It is another object of the present invention to provide a new roofer's step stilt which may be easily and efficiently manufactured and marketed.

It is a further object of the present invention to provide a new roofer's step stilt which is of a durable and reliable construction.

An even further object of the present invention is to provide a new roofer's step stilt which is susceptible of a low cost of manufacture with regard to both materials and labor, and which accordingly is then susceptible of low prices of sale to the consuming public, thereby making such roofer's step stilt economically available to the buying public.

Still yet another object of the present invention is to provide a new roofer's step stilt which provides in the apparatuses and methods of the prior art some of the advantages thereof, while simultaneously overcoming some of the disadvantages normally associated therewith.

Still another object of the present invention is to provide a new roofer's step stilt for providing an adjustably extendable stilt for bracing on a toe hold structure on a roof top to allow a roofer to step thereon to reach higher up locations without requiring additional scaffolding to be constructed.

Yet another object of the present invention is to provide a new roofer's step stilt which includes a tubular elongate top and bottom members each having upper and lower ends and a longitudinal axis extending between the respective upper and lower ends. The lower end of the top member telescopically receives the upper end of the bottom member into the top member. An upper footrest plate is coupled to the upper end of the top member. A lower footrest plate is outwardly extended from the top member adjacent the lower end of the top member.

Still yet another object of the present invention is to provide a new roofer's step stilt that lets a user reach safely reach higher locations on a roof top.

Even still another object of the present invention is to provide a new roofer's step stilt that collapsible for easy transport and storage.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
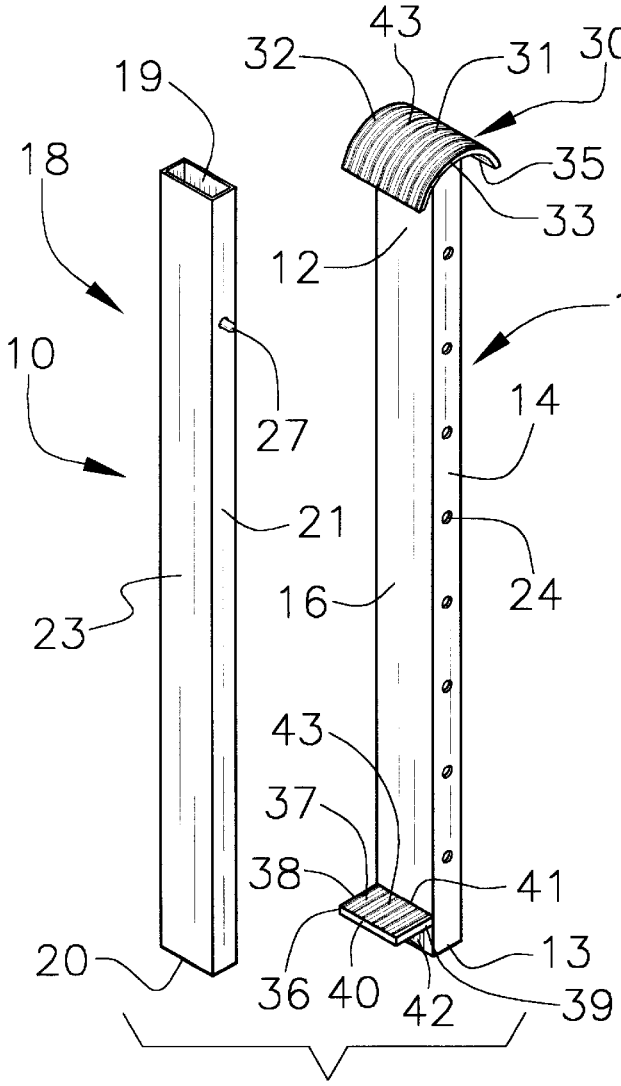
FIG. 1 is a schematic perspective view of a new roofer's step stilt with the top and bottom members separated from one another.
Figure 2:
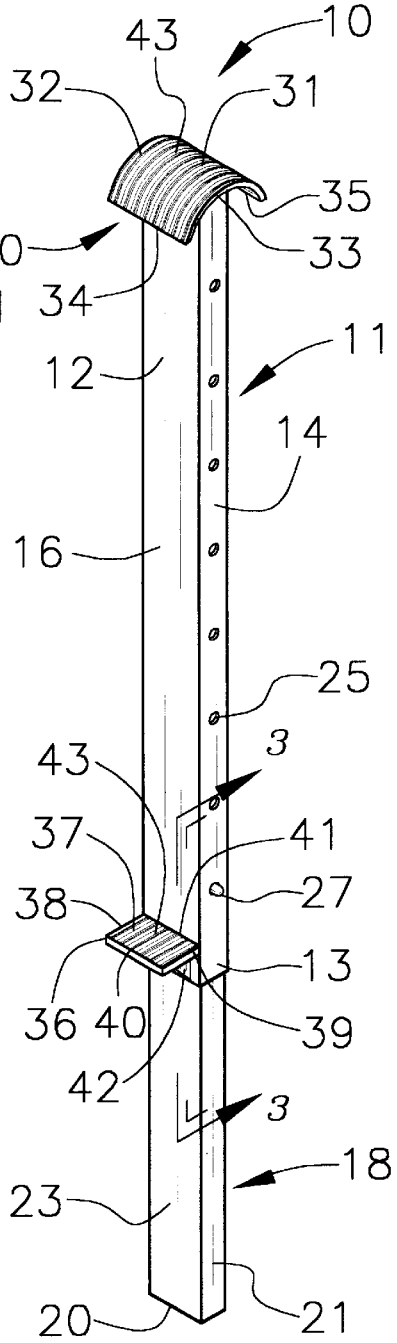
FIG. 2 is a schematic perspective view of the present invention.
Figure 3:
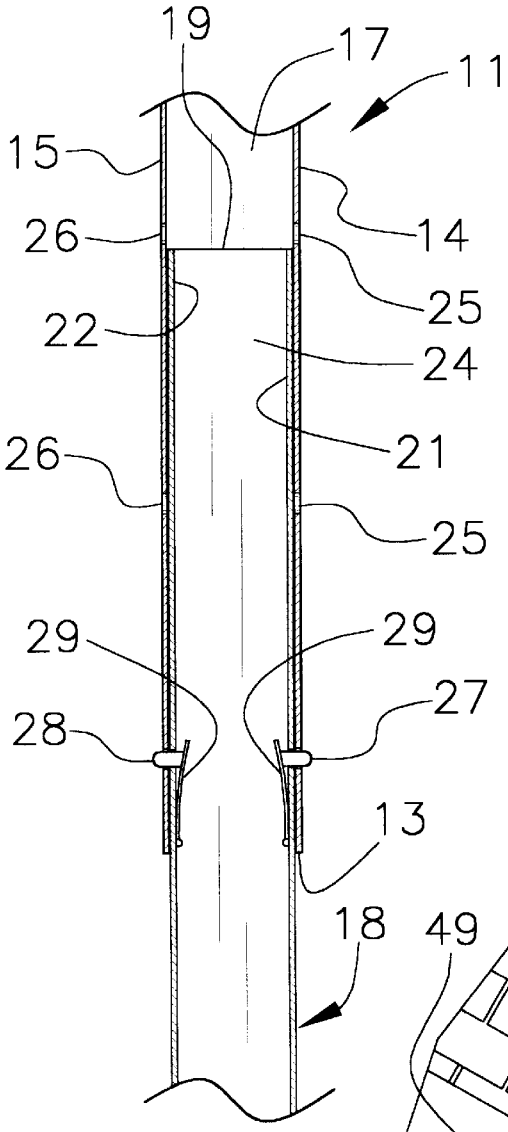
FIG. 3 is a schematic cross sectional view of the present invention taken from line 3—3 of FIG. 2.
Figure 4:
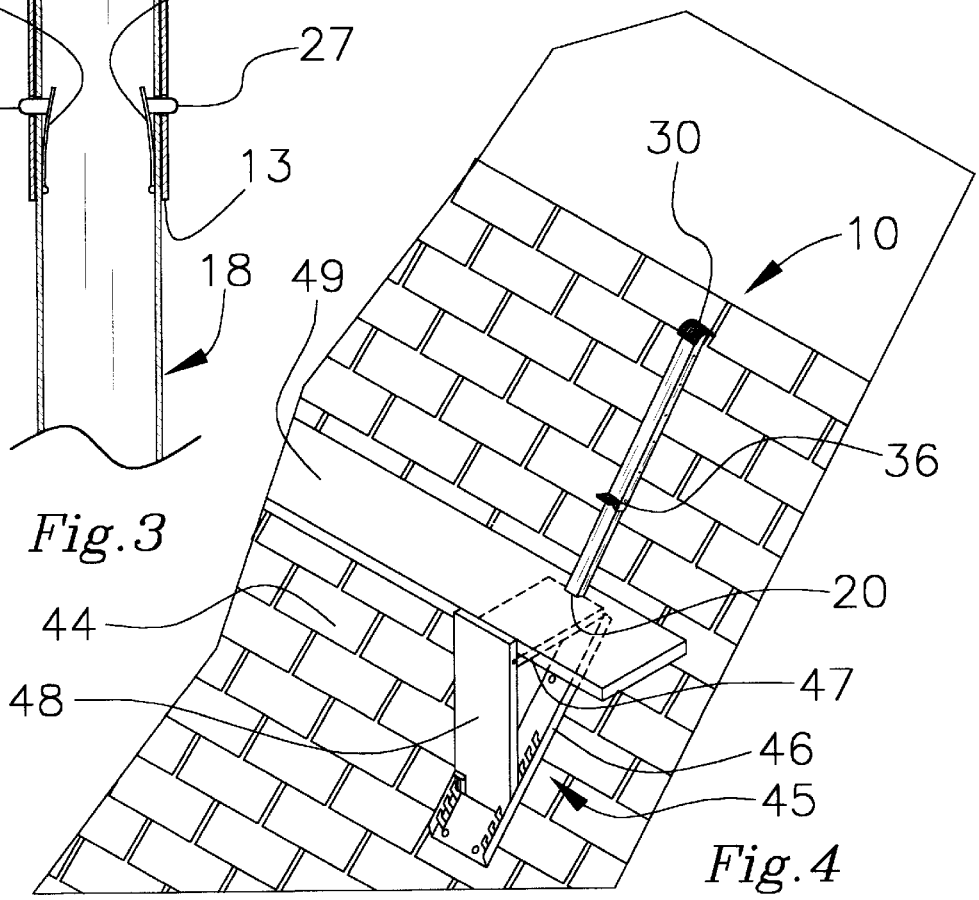
FIG. 4 is a schematic perspective view of the present invention in use on a roof.

With reference now to the drawings, and in particular to FIGS. 1 through 4 thereof, a new roofer's step stilt embodying the principles and concepts of the present invention and generally designated by the reference numeral 10 will be described.

As best illustrated in FIGS. 1 through 4, the roofer's step stilt 10 generally comprises a tubular elongate top and bottom members each having upper and lower ends and a longitudinal axis extending between the respective upper and lower ends. The lower end of the top member telescopically receives the upper end of the bottom member into the top member. An upper footrest plate is coupled to the upper end of the top member. A lower footrest plate is outwardly extended from the top member adjacent the lower end of the top member.

In closer detail, the step stilt comprises a tubular elongate top member 11 having an upper end 12, an open lower end 13 and a longitudinal axis extending between the upper and lower ends of the top member. The top member has a generally rectangular transverse cross section taken from a plane extending substantially perpendicular to the longitudinal axis of the top member. The top member has a plurality of sides extending between the upper and lower ends of the top member with a first pair of opposite sides 14,15 of the plurality of sides of the top member extending substantially parallel to one another and a second pair of opposite sides 16,17 of the plurality of sides of the top member extending substantially parallel to one another and substantially perpendicular to the first pair of opposite sides of the top member.

The top member has a length defined between the upper and lower ends of the top member, a width defined between the first pair of opposite sides of the top member and a depth defined between the second pair of opposite sides of the top member. In an ideal illustrative embodiment, the length of the top member is about 30 inches, the width of the top member is about 3 inches and the depth of the top member is about 1½ inches. In another embodiment, the width and the depth of the top member may both be about 1½ inches so that the top member has a substantially square transverse cross section.

The tubular elongate bottom member 18 has opposite upper and lower ends 19,20 and a longitudinal axis extending between the upper and lower ends of the bottom member. Like the top member, the bottom member has a generally rectangular transverse cross section taken from a plane extending substantially perpendicular to the longitudinal axis of the bottom member. Accordingly, the bottom member has a plurality of sides extending between the upper and lower ends of the bottom member with a first pair of opposite sides 21,22 of the plurality of sides of the bottom member extending substantially parallel to one another and a second pair of opposite sides 23,24 of the plurality of sides of the bottom member extending substantially parallel to one another and substantially perpendicular to the first pair of opposite sides of the bottom member.

The bottom member has a length defined between the upper and lower ends of the bottom member, a width defined between the first pair of opposite sides of the bottom member and a depth defined between the second pair of opposite sides of the bottom member. In one ideal illustrative embodiment, the length of the bottom member is about 30 inches, the width of the bottom member is about 2⅞ inches and the depth of the bottom member is about 1⅜ inches.

The lower end of the top member telescopically receives the upper end of the bottom member into the top member such that the bottom member is slidably extendable from and retractable into the lower end of the top member. The first pair of opposite sides of the top and bottom members are substantially parallel with one another and the second pair of opposite sides of the top and bottom members is substantially parallel with one another.

The sides of the first pair of opposite sides of the top member each have a plurality of generally circular holes 25,26 arranged in a row extending between the upper and lower ends of the top member along the respective side. The holes of each side of the first pair of opposite sides of the top member are spaced apart at generally equal intervals in the respective row of holes. Each hole of one of the sides of the first pair of opposite sides of the top member is substantially coaxially aligned with a corresponding hole of the other of the sides of the first pair of opposite sides of the top member.

The sides of the first pair of opposite sides of the bottom member each have an outwardly biased spring biased set pin 27,28 outwardly extending therefrom. The set pins are substantially coaxially aligned with one another. Each set pin is extended through an aperture in the respective side of the bottom member and has a leaf spring 29 coupled thereto and to the respective side inside the bottom member. The set pin of one of the sides of the first pair of opposite sides of the bottom member is removably inserted into a hole of one of the sides of the first pair of opposite sides of the top member. Similarly, the set pin of the other of the sides of the first pair of opposite sides of the bottom member is removably inserted into a coaxially aligned associated hole of the other of the sides of the first pair of opposite sides of the top member. In this arrangement, the set pins hold the top and bottom members in a fixed position with respect to one another when the set pins are extended through an coaxially aligned pair of holes of the top member.

Optionally, the sides of the first pair of opposite sides of the bottom member may each have a plurality of generally circular holes arranged in a row extending between the upper and lower ends of the bottom member along the respective side. In this embodiment an elongate cotter pin has a flexible cord coupling the cotter pin to the top member may be extended through coaxially aligned holes of the top and bottom members to hold the top and bottom members in a fixed position with respect to one another.

An upper footrest plate 30 is coupled to the upper end of the top member. The upper footrest plate has a convex upper face 31, and an outer perimeter comprising a pair of arcuate end edges 32,33 and a pair of substantially parallel side edges 34,35. The end edges of the top plate lie in plates extending substantially parallel to the first pair of opposite sides of the top member and the side edges of the top plate are extended substantially parallel to the second pair of opposite sides of the top member. The upper footrest plate is preferably centered with the longitudinal axis of the top member and lie in a plane substantially perpendicular to the longitudinal axis of the top member.

The upper footrest plate has a width defined between the end edges of the upper footrest plate and a depth defined between the side edges of the upper footrest plate. In the ideal illustrative embodiment, the width of the upper footrest plate is about 5 inches and the depth of the upper footrest plate is about 3 inches.

A generally rectangular lower footrest plate 36 is outwardly extended from one of the sides of the second pair of opposite sides of the top member. The lower footrest plate is positioned adjacent the lower end of the top member. The lower footrest plate has an upper face 37, and an outer perimeter comprising a pair of substantially parallel end edges 38,39 and a pair of substantially parallel side edges 40,41 extending substantially perpendicular to the end edges of the lower footrest plate. The end edges of the top plate are extended substantially parallel to the first pair of opposite sides of the top member and the side edges of the top plate are extended substantially parallel to the second pair of opposite sides of the top member One of the side edges of the lower footrest plate is coupled to the one side of the second pair of opposite sides of the top member. Preferably, a generally triangular brace 42 is coupled to a lower face of the lower footrest plate and the one side of the second pair of opposite sides of the top member for providing additional structural strength to the coupling between the lower footrest plate and the top member. The lower footrest plate lies in a plane substantially perpendicular to the longitudinal axis of the top member.

The lower footrest plate has a width defined between the end edges of the lower footrest plate and a depth defined between the side edges of the lower footrest plate. In the ideal illustrative embodiment, the width of the lower footrest plate is about 3 inches and the depth of the lower footrest plate is about 2 inches.

Ideally, the upper faces of the upper and lower footrest plates each have a frictionally enhanced surface 43 with respect to a smooth surface for frictionally enhancing contact between the upper faces of the upper and lower footrest plates and user's foot engaging the respective upper face.

In use, the extendable step stilt is designed for use on a roof 44 and for resting against various toe hold structures on a roof such as a roof bracket 45 of a roof scaffolding coupled to the roof to permit a user to step thereon to reach higher locations on the roof. The typical roof scaffolding comprises a pair of generally triangular roof brackets each having a strap portion 46 with holes at one end for fastening to a roof. Each roof bracket also has a shelf portion 47 braced by an upright portion 48 extending between the shelf and the strap portion. The roof scaffolding also has a plank 49 resting on the shelves of the roof brackets on which a user may stand, In use, the lower end of the bottom member is designed for resting against a shelf of a roof brace such that the top and bottom members upwardly extend along the roof with the longitudinal axes of the members parallel with the roof and the lower foot rest outwardly extending in a direction away from the roof. This allows a user standing on the plank to step on to the lower and upper footrest plates to reach higher up locations that are not reachable when standing on the plank. This eliminates the need for the user to create additional roof scaffolding when trying to reach higher up locations.

Ideally, the lower end of the bottom member also has a frictionally enhanced surface with respect to a smooth surface for frictionally enhancing contact between the lower end of the bottom member and a surface the lower end is engaging such as a shelf of a roof brace.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An extendable step stilt, comprising:

a tubular elongate top member having an upper end, an open lower end and a longitudinal axis extending between said upper and lower ends of said top member;

a tubular elongate bottom member having opposite upper and lower ends and a longitudinal axis extending between said upper and lower ends of said bottom member;

said lower end of said top member telescopically receiving said upper end of said bottom member into said top member;

said top member having a length between said upper end and said lower end, said bottom member having a length between said upper end and said lower end, said length of said top member being greater than said length of said bottom member, said top member being adapted to receive the entire said length of said bottom member to thereby minimize the size of said members in a collapsed condition;

an upper footrest plate being coupled to said upper end of said top member;

a lower footrest plate being outwardly extended from said top member adjacent said lower end of said top member wherein said upper foot rest plate has a convex upper face, and an outer perimeter comprising a pair of arcuate end edges and a pair of substantally parallel side edges, said end edges of said upper footrest plate lying in planes extending substantially parallele to a first pair of opposite sides of said top member and said side edges of said upper footrest plate lying in planes substantially parallel to a second pair of opposite sides of said top member; said upper foot rest plate being centered with said longitudinal axis of said top member and lying in a plane substantially perpendicular to said longitudinal axis of said top member; said lower footrest plate an upper face, and an outer perimeter comprising a pair of sustantially parallel end edges and a pair of substantially parallel side edges extending substantially parallel to said end edges of said lowere footrest plate, said end edges of said lower footrest plate lying in planes substantilally parallel to said first pair of opposite sides of said top member and said side edges of said lower footrest plate lying in planes substantially parallel to said second pair of opposites of said top member.

2. The extendable step stilt of claim 1, wherein said top member has a plurality of holes arranged in a row extending between said upper and lower ends of said top member, wherein said bottom member has an outwardly biased spring biased set pin outwardly extending therefrom, wherein said set pin is removably inserted into a hole of said top member.

3. The extendable step stilt of claim 1, wherein said lower footrest plate is extended substantially perpendicular to said longitudinal axis of said top member.

4. The extendable step stilt of claim 1, wherein a generally triangular brace is coupled to a lower face of said lower footrest plate and said top member.

5. The extendable step stilt of claim 1, wherein said upper and lower footrest plates each have an upper face having a frictionally enhanced surface with respect to a smooth surface.

6. An extendable step stilt, comprising:

a tubular elongate top member having an upper end, an open lower end and a longitudinal axis extending between said upper and lower ends of said top member;

said top member having a generally rectangular transverse cross section taken from a plane extending substantially perpendicular to said longitudinal axis of said top member;

said top member having a plurality of sides extending between said upper and lower ends of said top member, a first pair of opposite sides of said plurality of sides of said top member being extended substantially parallel to one another, a second pair of opposite sides of said plurality of sides of said top member being extended substantially parallel to one another and substantially perpendicular to said first pair of opposite sides of said top member;

a tubular elongate bottom member having opposite upper and lower ends and a longitudinal axis extending between said upper and lower ends of said bottom member;

said bottom member having a generally rectangular transverse cross section taken from a plane extending substantially perpendicular to said longitudinal axis of said bottom member;

said bottom member having a plurality of sides extending between said upper and lower ends of said bottom member, a first pair of opposite sides of said plurality of sides of said bottom member being extended substantially parallel to one another, a second pair of opposite sides of said plurality of sides of said bottom member being extended substantially parallel to one another and substantially perpendicular to said first pair of opposite sides of said bottom member;

said lower end of said top member telescopically receiving said upper end of said bottom member into said top member such that said bottom member is extendable from said lower end of said top member;

said sides of said first pair of opposite sides of said top member each having a plurality of holes arranged in a row extending between said upper and lower ends of said top member along the respective side;

said holes of each side of said first pair of opposite sides of said top member being spaced apart at generally equal intervals in the respective row of holes;

each hole of one of said sides of said first pair of opposite sides of said top member being substantially coaxially aligned with a corresponding hole of the other of said sides of said first pair of opposite sides of said top member;

said sides of said first pair of opposite sides of said bottom member each having an outwardly biased spring biased set pin outwardly extending therefrom, said set pins being substantially coaxially aligned with one another;

said set pin of one of said sides of the first pair of opposite sides of said bottom member being removably inserted into a hole of one of the sides of the first pair of opposite sides of the top member, said set pin of the other of said sides of the first pair of opposite sides of said bottom member being removably inserted into a coaxially aligned associated hole of the other of the sides of the first pair of opposite sides of the top member, said set pins holding said top and bottom members in a fixed position with respect to one another when said set pins are extended through an coaxially aligned pair of holes of said top member;

an upper footrest plate being coupled to said upper end of said top member;

said upper footrest plate having a convex upper face, and an outer perimeter comprising a pair of arcuate end edges and a pair of substantially parallel side edges;

said end edges of said upper footrest plate lying in planes extending substantially parallel to said first pair of opposite sides of said top member and said side edges of said upper footrest plate lying in planes substantially parallel to said second pair of opposite sides of said top member;

said upper footrest plate being centered with said longitudinal axis of said top member and lying in a plane substantially perpendicular to said longitudinal axis of said top member;

a generally rectangular lower footrest plate being outwardly extended from one of said sides of said second pair of opposite sides of said top member, said lower footrest plate being positioned adjacent said lower end of said top member;

said lower footrest plate having an upper face, and an outer perimeter comprising a pair of substantially parallel end edges and a pair of substantially parallel side edges extending substantially perpendicular to said end edges of said lower footrest plate;

said end edges of said low footrest plate lying in planes substantially parallel to said first pair of opposite sides of said top member and said side edges of said lower footrest plate lying in planes substantially parallel to said second pair of opposite sides of said top member one of said side edges of said lower footrest plate being coupled to said one side of said second pair of opposite sides of said top member;

a generally triangular brace being coupled to a lower face of said lower footrest plate and said one side of said second pair of opposite sides of said top member;

said lower footrest plate lying in a plane substantially perpendicular to said longitudinal axis of said top member wherein said upper faces of said upper and lower footrest plates each have a frictionally enhanced surface with respect to a smooth surface; and wherein said lower end of said bottom member has have a frictionally enhanced surface with respect to a smooth surface.

* * * * *